US005785669A

United States Patent [19]

Proctor et al.

[11] Patent Number: 5,785,669

[45] Date of Patent: Jul. 28, 1998

[54] BACK SUPPORTING AND EXERCISING CUSHION

[76] Inventors: Richard I. Proctor, 2175 Danberry, San Rafael, Calif. 94903; Robert E. Fuller, 885 Gravenstein Hwy. North, Sebastopol, Calif. 95472

[21] Appl. No.: 421,501

[22] Filed: Apr. 12, 1995

[51] Int. Cl.[6] ..... A61H 7/00

[52] U.S. Cl. ..... 601/148; 601/23; 601/24; 5/655.3; 297/284.6

[58] Field of Search ..... 601/148, 149, 601/150, 152, 23, 24, 49; 297/284.6; 128/DIG. 20; 5/655.3, 654, 707, 713

[56] References Cited

U.S. PATENT DOCUMENTS

| | | | |
|---|---|---|---|
| 3,145,054 | 8/1964 | Sopko, Jr. | 5/655.3 |
| 3,595,223 | 7/1971 | Castagna | 601/148 |
| 3,680,917 | 8/1972 | Harris | 5/655.3 |
| 3,924,613 | 12/1975 | Beck | 601/149 |
| 3,987,506 | 10/1976 | Markwitz | 601/149 |
| 4,193,149 | 3/1980 | Welch | 5/713 |
| 4,467,484 | 8/1984 | Nagatake et al. | 5/655.3 |
| 4,624,248 | 11/1986 | Poole et al. | 601/148 |
| 4,682,588 | 7/1987 | Curlee | 128/DIG. 20 |
| 5,135,282 | 8/1992 | Pappers | 601/148 |
| 5,193,549 | 3/1993 | Bellin et al. | 128/DIG. 20 |
| 5,338,276 | 8/1994 | Jull et al. | 601/23 |
| 5,611,772 | 3/1997 | Fujimoto et al. | 601/150 |

FOREIGN PATENT DOCUMENTS

| | | | |
|---|---|---|---|
| 0128534 | 12/1984 | European Pat. Off. . | |
| 000270699 | 6/1988 | European Pat. Off. | 601/148 |
| 406090834 | 4/1994 | Japan | 297/284.6 |

*Primary Examiner*—Robert A. Hafer
*Assistant Examiner*—Justine R. Yu
*Attorney, Agent, or Firm*—Thomas M. Freiburger

[57] ABSTRACT

A back supporting and exercising cushion has upper and lower pneumatic chambers with an orifice or adjustable flow valve between the chambers for controlling shifting of air between the two chambers. With the back support device positioned in a chair or car seat, for example, the lower chamber is situated against the lumbar region of the back while the upper chamber presses against the mid-thoracic region. When the user shifts his posture, the chambers continually accommodate the changes by inflating one chamber while the pressure deflates air out of the other chamber. The ability to change posture frequently decreases fatigue in the low back while driving, for example, and provides neurological stimulation in the joints of the spine, which can help balance activities of the muscles in the back and decrease pain.

1 Claim, 7 Drawing Sheets

BACK SUPPORTING AND EXERCISING CUSHION

BACKGROUND OF THE INVENTION

The invention is generally in the field of medical apparatus, and in particular is directed to a back support device which both provides support for lumbar and thoracic regions of the back, continuously adjustable to the needs of the user, and also enables a simple therapeutic exercise by the user for improving the health and comfort of the spine.

Back rest cushions in many different forms have been notoriously well known. Cushions in many different shapes, sizes and constructions have been available for aiding in the comfort of the spine, while a user sits in a chair or automobile seat. A number of devices have included cushioning foam inserts and some have been inflatable. In fact, inflation devices have been included in automotive seats, controlled by small air pumps which are manually activated by the driver.

One example of a back supporting car seat cushion is shown in U.S. Pat. No. 4,535,495.

There has been a need for a lumbar/thoracic back cushion which not only accommodates to the user's varying posture but which also enables the user to carry out simple exercises for both the lower back and the abdomen and which tends to improve the condition of the spine.

SUMMARY OF THE INVENTION

In a back support and exercise device in accordance with the present invention, a pair of inflatable bladders are positioned at vertically spaced locations, connected through a flexible conduit. Air or other gas can be transferred from one pneumatic bladder to the other, via differential pressure exerted against one bladder as compared to the other. The flexible fluid conduit between the bladders includes a flow restrictive orifice, providing a resistance to flow and regulating the rate at which the inflation can be transferred between the two bladders. A suitable form of frame or connecting means holds the two pneumatic bladders at the desired spaced apart locations relative to one another, and an outer cover, preferably of fabric, encases the bladders and frame in a preferred embodiment.

Thus, the cushion and exercising device of the invention can be placed against the back support of a chair or automobile seat, and the relative inflations of the two bladders will adjust themselves to accommodate the user's posture. The user's posture can be shifted repeatedly, and the back supporting device will "adjust" to the changing posture by shifting the air or other gas from one chamber to the other until an equilibrium of essentially equal pressure is achieved between the two chambers or bladders. In this way, if the user pushes back with greater pressure in, say, the mid-thoracic area of the spine, against the support, this will shift air from the upper bladder down into the lower bladder, and the user will feel a comforting support against the lumbar region, even though the lumbar has moved outwardly from the chair or seat.

Also, the user can deliberately exercise the lumbar/mid- to lower-thoracic region of the spine by alternating pushing back with the lumbar region and contracting the abdominal muscles, then pushing back with the thoracic spine and contracting the lower back, initiating a flexion/extension exercise for the spine. This constitutes a therapeutic exercise which can strengthen the lower back, improve posture and improve the general function of the spine which helps to decrease back pain.

In one preferred embodiment the two chambers or bladders can be subjected to additional inflation or can be vented to reduce inflation, through a manual action by of the user releasing a valve. A squeeze bulb type air pump is included in one preferred embodiment, connected into the flexible conduit between the two bladders, to allow the user to increase inflation of both bladders. In a preferred embodiment a valve is included, operable by a thumb or thumb and forefinger of the user while the squeeze bulb is held in the hand, to release air or gas from the bladders, thereby lowering pressure. Further, in a preferred embodiment the flow resisting orifice in the conduit between the two bladders is adjustable. As on some mechanical exercising equipment, this adjustment permits the user to vary the resistance to lumbar and thoracic exercising movement, by varying the resistance to flow between the two chambers or bladders.

It is therefore seen that the back exercising and supporting device of the invention provides the important functions of cushioning the back in a comfortable and adjustable manner, one which continuously accommodates shifting seated posture of the user, while also permitting the user to carry out simple therapeutic exercises which help improve the strength and the comfort of the back and help prevent back pain. These and other objects, advantages and features of the invention will be apparent from the following description of a preferred embodiment, considered along with the accompanying drawings.

DESCRIPTION OF PREFERRED EMBODIMENTS

Figure 1:
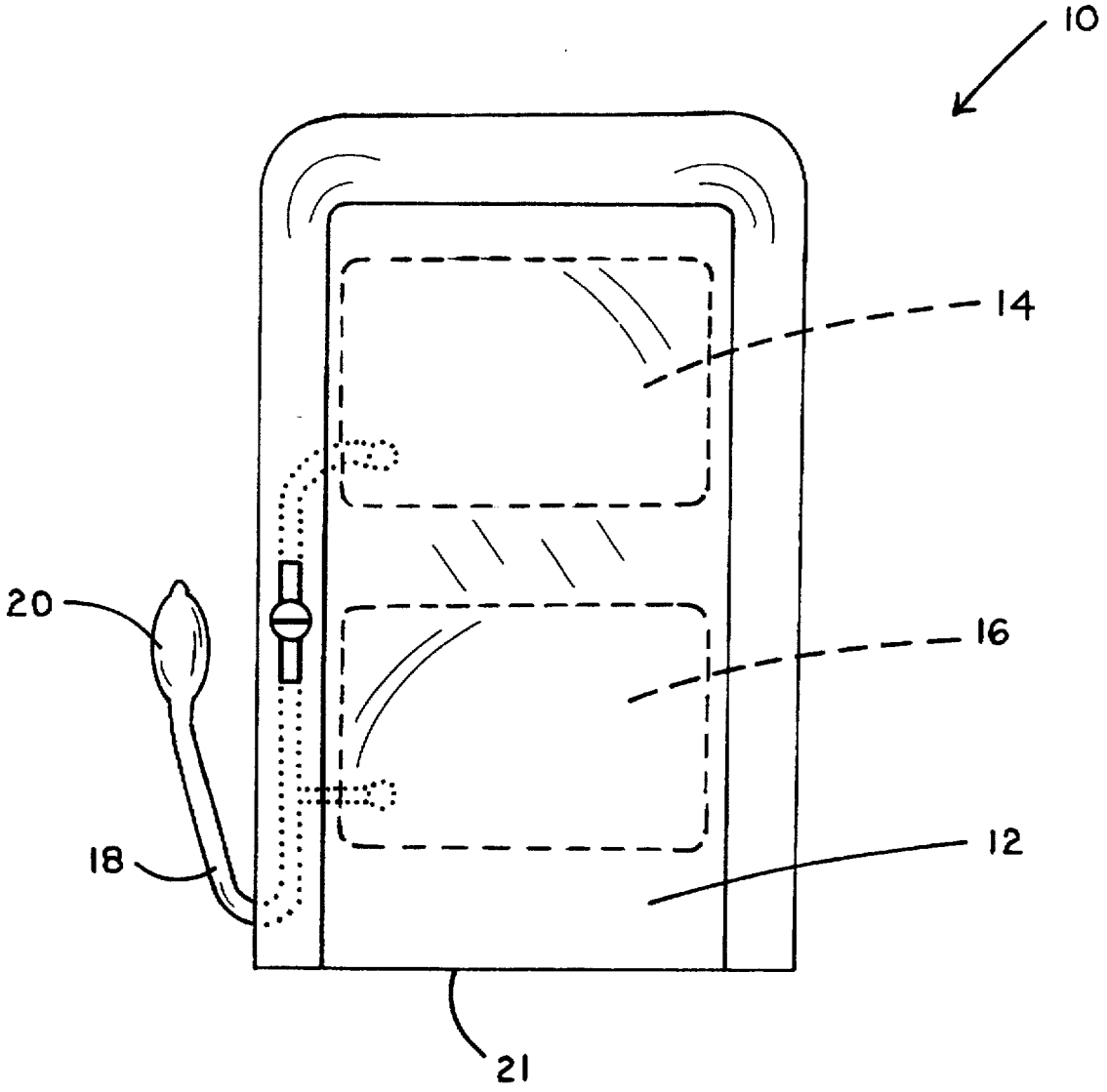
FIG. 1 is a frontal view, showing a back supporting and exercising device in the form of a cushion with internal air bladders, in accordance with the invention.
Figure 2:
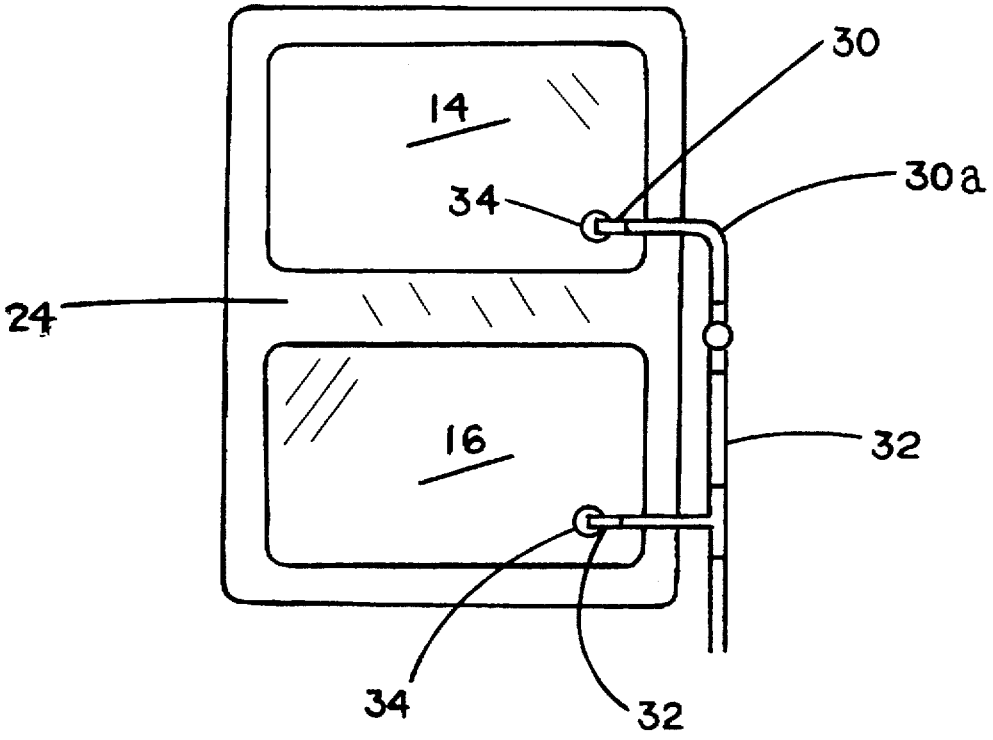
FIG. 2 is a plan view showing a form of pneumatic insert which may be employed in the embodiment of FIG. 1, with a pair of air bladders formed between sheets of plastic material.
Figure 6:
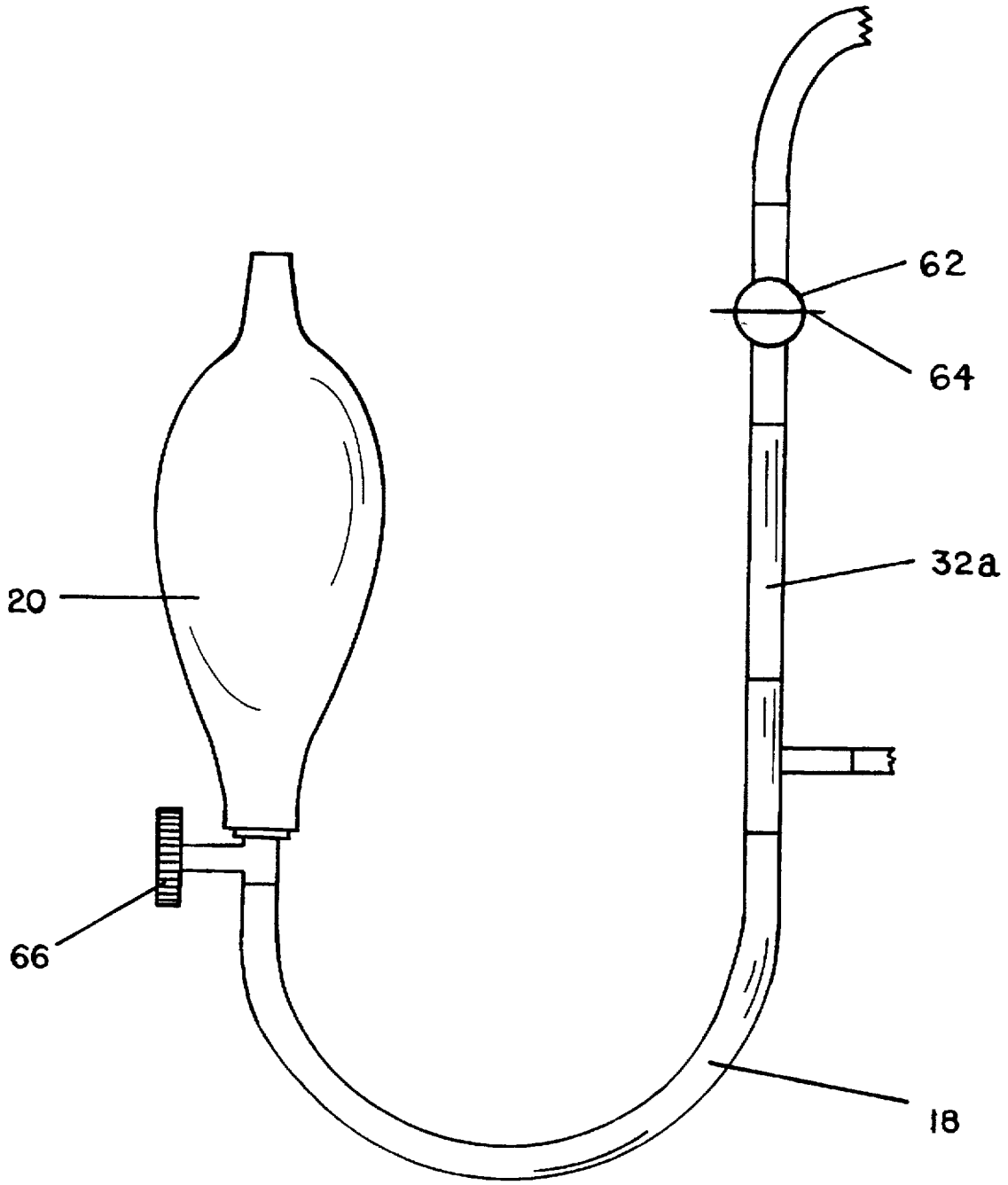
FIG. 6 is a schematic detail view showing an arrangement for inflating the pneumatic bladders and for regulating flow between them.

FIG. 1 shows a back support and exercising device generally identified as 10, including an external cover 12 which preferably has a desired degree of padding. Within the cover 12 are a pair of upper and lower pneumatic bladders 14 and 16, shown in dashed lines in FIG. 1. These bladders are connected to an air line or air lines shown at 18, leading to an inflating squeeze bulb 20 as part of a manual control discussed below relative to other drawing figures. FIGS. 1, 2 and 6 show that the squeeze bulb (or other inflating means) may be connected into the air lines at a position between the upper and lower bladders 14 and 16. The air line passes through the cover or casing preferably at a side opening discussed below. An overlap line 21 extending through the length of the bottom of the back cushion device 10 as seen in FIG. 1 closes the cover at the bottom. This can be via cooperating hook-and-loop fastener material (Velcro) on flaps which overlap one another, snap fasteners, or other suitable forms of fastener.

FIG. 2 shows the back side of an insert device 22 which comprises a bladder forming insert. The upper and lower pneumatic bladders 14 and 16 are shown in this particular embodiment as formed by a pair of plastic (preferably vinyl) sheets, one sheet 24 of which is seen in FIG. 2, the other being underneath. The laminated plastic sheets in this embodiment are heat-sealed around the bladders and preferably at all areas other than the bladders 14 and 16. Thus the bladders are formed in spaced-apart relationship as shown. The spacing between bladder centers is such as to generally match the vertical distance between the lumbar and mid-thoracic to upper thoracic region of the human spine.

As seen in FIG. 2, a pair of tubes or conduits 30 and 32 are each secured into one side of the laminated vinyl bladder forming insert 22. Preferably the tubes 30 enter at the back side of the insert member 22, i.e. at the back of each bladder as shown, so as to maximize comfort to the user, whose spine rests against the front side of the device. Such connections between a conduit and a heat-seal-formed bladder are well known, and usually involve some form of reinforcement device (shown at 34), which may itself be heat sealed to the vinyl material to form a rugged connection which will not develop leaks in normal use of the back support device 10.

FIG. 2 also shows that the upper and lower bladder tubes or conduits 30 and 32 come together via portions 30*a* and 32*a* to form the generally identified air conduit 18 shown in FIG. 1. This can be in the series type configuration shown, or other arrangements can be used.

Figure 3:
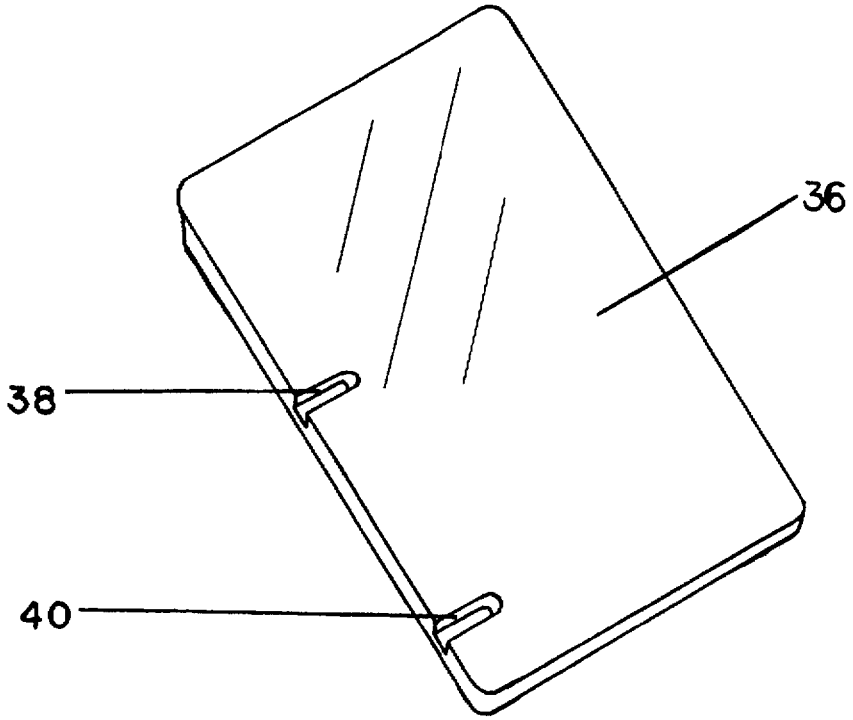
FIG. 3 is a perspective view showing a foam pad, preferably used behind the insert of FIG. 2 and included in the assembly of FIG. 1.
Figure 4:
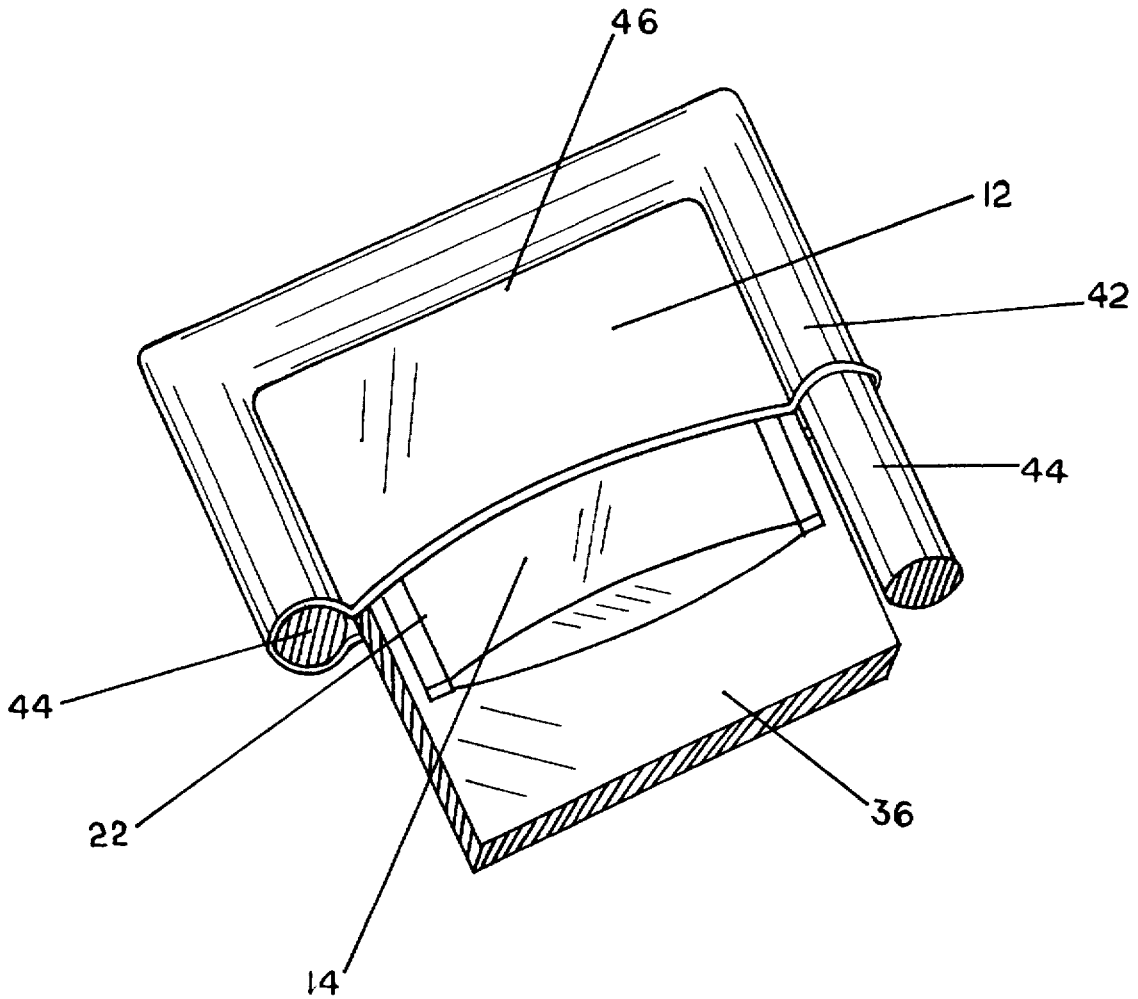
FIG. 4 is a partially cut away perspective view showing portions of the assembly of FIG. 1.

FIG. 3 shows a foam pad 36 which preferably is of a size similar to that of the bladder forming insert 22. See also FIG. 4, showing the bladder forming insert 22 positioned against the foam pad 36. The pad 36 may be about one-half inch thick and of a relatively dense but compressible foam so as to add some degree of comfort to the device 10 and to provide a backing for the bladders 14 and 16. FIG. 3 shows that notches 38 and 40 are cut out of an edge of the foam pad, so as to accommodate the tubes 30 and 32 extending at the back of the plastic insert 22 when it is assembled against the pad.

FIG. 4 shows that the casing or cover 12, which may be formed of fabric, may have an edge piping 42 which encases a border piece of foam 44, extending at both sides and top of the cushion device. One procedure for producing this piping, encased border foam is to form the envelope of the cover 12, then put foam into the cover 12, at least a frame of foam which will fill the areas to become the piping 42. The cover may then be stitched along a stitch line 46, then the excess foam to the inside of the stitch line 46 may be cut away and discarded.

The cutaway view of FIG. 4 is shown cut through the upper bladder 14. The drawing reveals that the bladder 14 and the backing foam pad 36 are contained within the envelope of the casing 12, surrounded at left, right and top by the piping 42 and peripheral foam 44.

Figure 5:
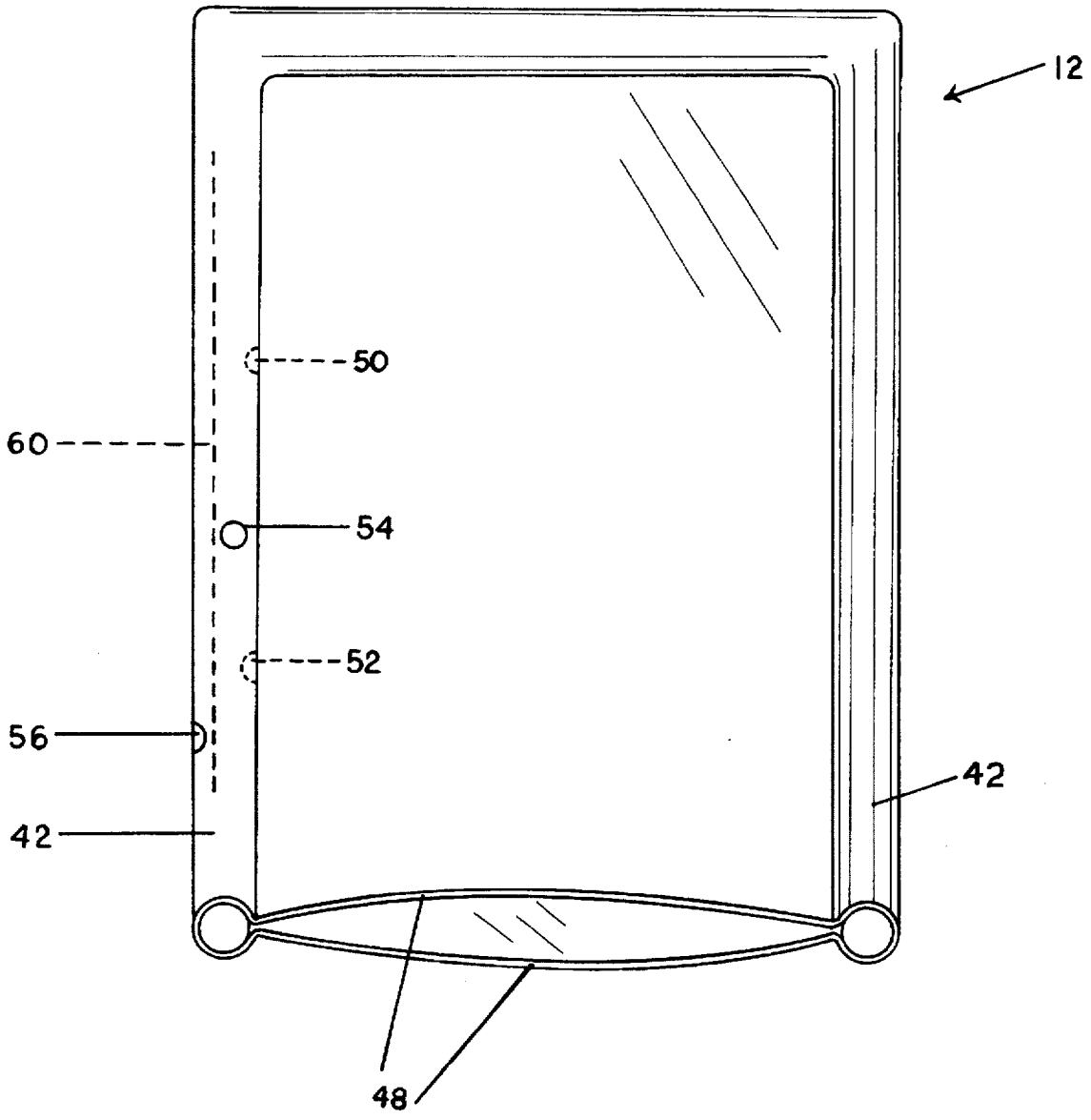
FIG. 5 is a perspective view showing the cover of the device illustrated in FIG. 1.

FIG. 5 shows the casing or outer covering 12. At the bottom of the casing the flap seam 21 (FIG. 1) is formed by overlapping a short width of the bottom edges 48 of the casing. The overlap may be about one-fourth inch to one-half inch. With the bladder-forming insert member 22, the foam pad 36 and the peripheral foam 44 contained within the casing 12, the edges 48, which extend beyond the contained components sufficiently to form the overlap, are lapped over and, as noted above, may be secured together with hook and loop fastener material. This is true of the central portion of the casing's bottom edge, as well as at the piping 42.

Figure 7:
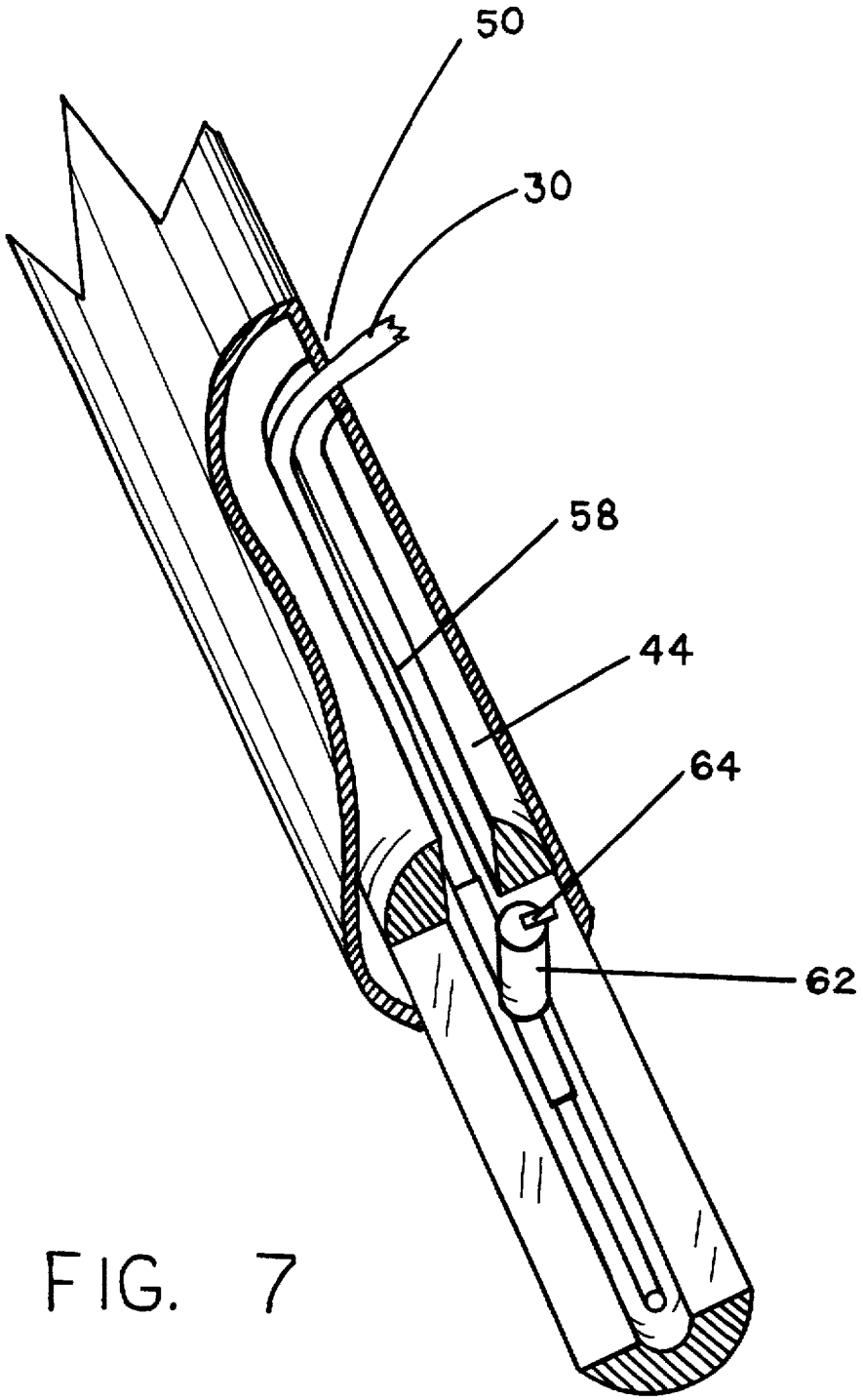
FIG. 7 is a schematic fragmentary view, partially cut away, illustrating the manner in which some of the inflating apparatus shown in FIG. 6 is incorporated in the back supporting device.

FIG. 5 also shows openings 50 and 52 (dotted lines), 54 and 56 formed in the piping. These openings are for pneumatic conduits, as can be seen from FIGS. 1 and 2. Tubes leading from the bladder exit tubes 30 and 32 pass through the holes 50 and 52 toward the back side of the casing and enter a channel formed in the peripheral foam within the piping. FIG. 7 shows, in cut away view, the bladder tube 30 passing through the opening 50 and lying in a channel 58 of the foam 44. The channel may be formed from the back side of the back cushion, by forming a slit 60 (dashed line in FIG. 5) in the back of the piping for access.

As also shown in the drawings, including FIG. 6, a valve 62 within the pneumatic conduit is positioned in the peripheral foam so as to be exposed through the hole 54 in the piping, shown in FIG. 5. The valve has a manual grip 64 which is made accessible by the opening 54.

Farther down the piping, the side hole 56 provides an exit for the conduit 18 which leads to the squeeze bulb 20 as best seen in FIGS. 1, 5 and 6. The conduit is shown oriented such that the squeeze ball extends upwardly, since the device 10 is intended for use on an automobile seat (as well as in other positions), and the bulb preferably extends out of the cushion on the user's right. In this way, the user can hold the bulb in hand and manipulate a screw valve 66 which may be positioned immediately at the end of the squeeze bulb.

The conduit and its various portions can be assembled via the openings 54 and 56, as needed. Also, it should be understood that the assembly details and means of access illustrated can be varied if desired.

In operation, the back supporting and exercising cushion device 10 may be placed in a chair or against the upright portion of a car seat. The two bladders are at least partially inflated. When the user pushes backward with the lumbar region of the spine, this tends to push air out of the pneumatic bladder 16, up through the conduit and through the valve 62, inflating the upper pneumatic bladder 14. The opposite is true if the user pushes back with the mid to upper thoracic region of the spine, thus pushing forward the lumbar region by inflation of the lower pneumatic bladder 16.

The valve 62 provides an orifice or restriction between the two air bladders 14 and 16. The valve and its rotatable adjustment grip 64 enable the user to adjust the size of this orifice and thus the degree to which exchange of gas between the two bladders is restricted or free-flowing. The valve 62 can actually be shut off completely in a preferred embodiment, which can be the position shown in FIG. 6. This will effectively lock the relative inflations of the two bladders.

The squeeze bulb 20 is used to provide inflation to the bladders. The manually-operated valve 66 can be used to release inflation from the bladders, in the event the user wishes to provide a softer, less firm support or if the user wishes to deflate both bladders and flatten the device for storage. A check valve can be included at the location of the valve 66, such that air can always be introduced into the bladders by squeezing the bulb, regardless of the setting of the manual valve 66; thus, the manual valve 66 is needed only to release air from the system.

It should be understood that the total amount of air in the bladders is an individual preference which can vary with the size or weight of the user or with settings that feel comfortable to the individual user, but sufficient air must be in the bladder to allow for exchange between bladders for exercise and accommodation of a user's changing positions. The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

We claim:

1. A method for exercising a user's back muscles and abdominal muscles comprising the steps of:

providing a back support device having upper and lower pneumatic bladders holding a gas, the upper and lower bladders being vertically separated a distance which approximates the vertical separation between the lumbar region and the mid- to upper-thoracic region of the user's spine, a fluid conduit connected in fluid communication with the upper and lower bladders to allow movement of gas between the bladders, and a housing means connecting the upper and lower bladders to form a unitary device;

placing the back support device against a seat back of a chair or seat;

contacting the back support device with the user's lower and upper back, from the lumbar spine region to the mid-thoracic spine region, the lower bladder being in contact with the user's lumbar spine region and the upper bladder being in contact with the user's mid-thoracic spine region;

pressing against the upper bladder with the user's mid-thoracic spine region and contracting the lower back muscles, until air has exchanged from the upper bladder into the lower bladder via the fluid conduit;

then pressing against the lower bladder with the user's lumbar spine region and contracting the abdominal muscles until air has exchanged from the lower bladder into the upper bladder via the fluid conduit; and repeating in alternate fashion the last two steps until a desired amount of exercise is achieved.

* * * * *

UNITED STATES PATENT AND TRADEMARK OFFICE

CERTIFICATE OF CORRECTION

PATENT NO. : 5,785,669

DATED : July 28, 1998

INVENTOR(S) : Richard I. Proctor, et al.

It is certified that error appears in the above-identified patent and that said Letters Patent is hereby corrected as shown below:

Column 3, line 67, after "member 22," insert --(shown in Figure 4)--.

Column 9, line 47, change "2" to --1--.

Column 10, line 5, change "2" to --1--.

Signed and Sealed this

Second Day of March, 1999

*Attest:*

*Attesting Officer*

Q. TODD DICKINSON

*Acting Commissioner of Patents and Trademarks*